US011912495B2

(12) United States Patent
Harloff

(10) Patent No.: US 11,912,495 B2
(45) Date of Patent: Feb. 27, 2024

(54) DOME COVER

(71) Applicant: IBAU HAMBURG INGENIEURGESELLSCHAFT INDUSTRIEBAU MBH, Hamburg (DE)

(72) Inventor: Oliver Harloff, Hamburg (DE)

(73) Assignee: IBAU HAMBURG INGENIEURGESELLSCHAFT INDUSTRIEBAU MBH, Hamburg (DE)

( * ) Notice: Subject to any disclaimer, the term of this patent is extended or adjusted under 35 U.S.C. 154(b) by 406 days.

(21) Appl. No.: 17/444,488

(22) PCT Filed: Aug. 8, 2019

(86) PCT No.: PCT/EP2019/071303
§ 371 (c)(1),
(2) Date: Aug. 5, 2021

(87) PCT Pub. No.: WO2020/160792
PCT Pub. Date: Aug. 13, 2020

(65) Prior Publication Data

US 2022/0194695 A1 Jun. 23, 2022

(30) Foreign Application Priority Data

Feb. 5, 2019 (EP) ..... 19155517

(51) Int. Cl.
*B65D 90/10* (2006.01)
*B65D 90/58* (2006.01)

(52) U.S. Cl.
CPC ..... *B65D 90/10* (2013.01); *B65D 90/585* (2013.01); *B65D 2590/666* (2013.01)

(58) Field of Classification Search
None
See application file for complete search history.

(56) References Cited

U.S. PATENT DOCUMENTS 6,105,805 A * 8/2000 Labelle ..... B60P 3/226 220/345.2
6,651,708 B2 11/2003 Gloor et al.
8,070,009 B2 * 12/2011 McKenzie ..... B60P 3/226 220/252

(Continued)

FOREIGN PATENT DOCUMENTS

DE 69718119 10/2003
EP 2546556 1/2013

*Primary Examiner* — Joshua K Ihezie
(74) *Attorney, Agent, or Firm* — Sand, Sebolt & Wernow Co., LPA

(57) ABSTRACT

A dome cover assembly for automatically opening and closing a through-opening. The dome cover includes at least one reach-around element on one of a cover and flange. The reach-around element at least partially encloses, in a first rotational position, the other of the cover and the flange on a side facing away from the first element. The other of the cover and flange has a recess and, in the first rotational position, the reach-around element engages behind the recess in a first distanced position of the cover and the flange. The reach-around element does not engage behind the recess in a second closer position of the cover and the flange.

19 Claims, 3 Drawing Sheets

(56) References Cited

U.S. PATENT DOCUMENTS

| | | | | |
|---|---|---|---|---|
| 2005/0166458 | A1* | 8/2005 | McKenzie | B65D 90/10 49/394 |
| 2008/0078127 | A1* | 4/2008 | Hill | E02D 29/1427 404/25 |
| 2012/0074144 | A1* | 3/2012 | McKenzie | B65D 90/10 220/263 |
| 2014/0237902 | A1* | 8/2014 | David | B65D 90/10 49/465 |

* cited by examiner

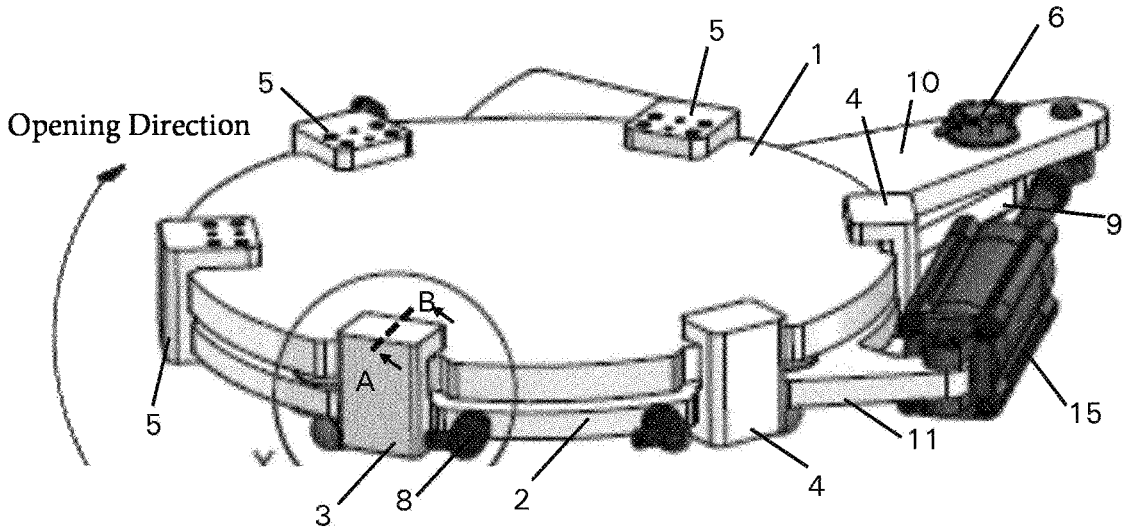
Fig. 1
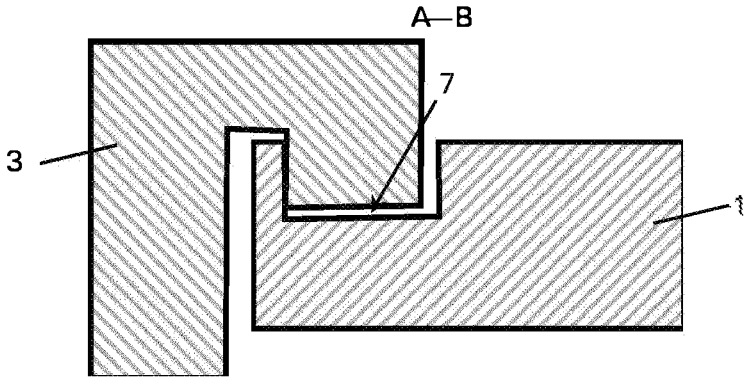
Fig. 2
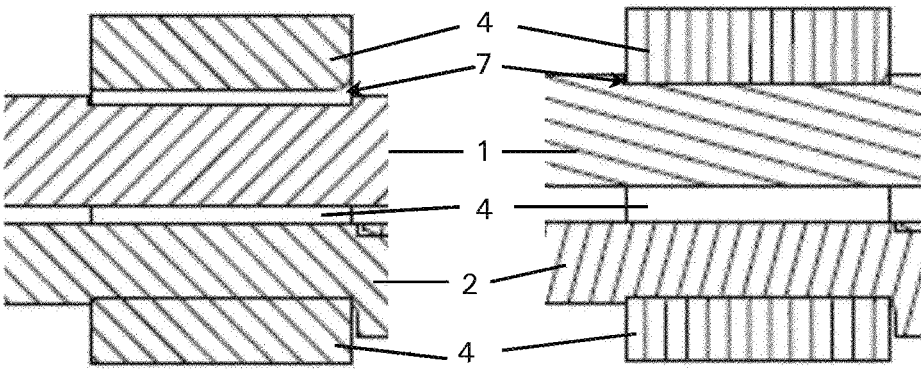
Fig. 3a
Fig. 3b

DOME COVER

TECHNICAL FIELD

The present invention relates to a dome cover assembly for automatically opening and closing a through-opening.

BACKGROUND

Background Information

An automatic dome cover assembly also extending inside the tank is known from U.S. Pat. No. 6,651,708 B2.

SUMMARY

The object of the present invention is to specify a dome cover assembly, a tank or vessel, and/or a tank or vessel vehicle which has a dome cover assembly, wherein the dome cover ensures that if there is a pressure in the tank or vessel and/or at the dome cover and/or a pressure in the tank or vessel and/or at the dome cover exceeding a predetermined limit and/or a pressure difference exceeding a predetermined limit via the dome cover, opening of the dome cover is prevented and wherein the dome cover assembly in particular does not require extension into the tank.

This is achieved by a dome cover assembly having a flange having a through-opening and a cover for closing the through-opening. The cover is rotatably mounted around an axis in relation to the flange, so that in a first rotational position, the cover is positioned over the through-opening, the through-opening is closed in particular, and in a second rotational position, the cover is positioned so that the through-opening is free, in particular uncovered and/or unclosed.

According to the invention, at least one first element of the elements cover and flange has at least one reach-around element, wherein the at least one reach-around element of the cover and/or the at least one reach-around element of the flange is respectively designed, in the first rotational position, to enclose at least partially the respective other element of cover and flange, on which the at least one reach-around element is not arranged, on the side facing away from the first element. The other element of cover and flange has a recess on the side facing away from the first element in the direction of the first element, wherein the at least one reach-around element and the recess are designed and arranged in such a way that in the first rotational position, in a first, distant position of cover and flange, the reach-around element engages in the recess, and in that in the first rotational position, in a second, closer position of cover and flange, the reach-around element does not engage in the recess in this closer position. The recess is not designed to extend up to the margin, in particular at least partially and/or the margin of the other element of cover and flange, in particular its margin and/or outer edge is not designed to extend up to the margin. Alternatively or additionally, the axis, the other element, and the reach-around element are designed and arranged in such a way that the reach-around element passes over at least one section of the recess during the rotation from the first into the second rotational position, wherein a greater distance is given between the side of the other element facing away from the first element and the projection before the passing over than after.

The object is also achieved by a tank or vessel, having a dome opening and a dome cover assembly according to the invention arranged on the dome opening, wherein the dome opening and the through-opening at least partially align and/or form a joint through-opening and wherein the dome cover assembly is designed and arranged to completely close the dome opening in the first rotational position, possibly with the use and/or activation and/or application of sealing means, in particular a hollow seal.

The object is also achieved by a tank or vessel vehicle according to the present disclosure, having a device for pressurizing the tank or vessel and/or a device for applying and venting gas and/or fluid to or from the cavity of the hollow seal.

The object is also achieved by a method for preventing the opening of a dome cover, which is in particular automatically openable and closable, of a tank or vessel, wherein the dome cover is in particular designed for opening and closing by rotation around an axis, wherein the opening and/or a rotation for opening is prevented by means of at least one reach-around element and a recess, which is in particular not extending up to the margin, by reaching of the reach-around element behind the recess, in particular engagement of a projection of the reach-around element in the recess, wherein the engagement of the reach-around element behind the recess is effectuated in particular at least partially by pressurizing the tank or vessel, in particular with closed dome cover, in particular by the pressure in the tank or vessel by the application, and/or by pressurizing a cavity of a hollow seal of the dome cover and/or tank and/or vessel and/or by pressurizing the tank and/or vessel and a cavity of a hollow seal. In this case, the dome cover assembly in particular has a flange and/or a through-opening and/or a cover for closing the through-opening. In this case, the cover is advantageously rotatably mounted in relation to the flange around an axis, so that in a first rotational position the cover is positioned above the passage opening, in particular closing it, and in a second rotational position the cover is positioned in such a way that the through-opening is free. In particular, opening and closing of the through-opening and/or dome opening is also at least partially effectuated by rotation between first and second position. In particular, the at least one reach-around element is arranged on a first element of the elements cover and flange and/or the reach-around element is designed, in the first rotational position, to enclose at least partially the respective other element of cover and flange on which this at least one reach-around element is not arranged, on the side facing away from the first element. In particular, the other element of cover and flange in particular has a recess, which is not extending up to the margin in particular, on the side facing away from the first element in the direction of the first element, wherein reach-around element and recess are in particular designed and arranged in such a way that in the first rotational position, in a first, distant position of cover and flange, the reach-around element engages in the recess, and in that in the first rotational position, in a second, closer position of cover and flange, the reach-around element does not engage behind the recess in this closer position.

In particular, the reach-around element is positioned during the movement into the first rotational position, in the second, closer position, the reach-around element, is positioned, in particular only by the rotation, in such a way that during the transition from the second, closer position into the first, distant position, in the first rotational position it engages with its projection in the recess. In particular, the reach-around element is positioned in the second, closer position here in such a way that its projection is located so that it in a projection parallel to the longitudinal extension axis it is in the recess.

The rotation from the second rotational position is advantageously limited by a geometry of an indentation, which is in particular spit-shaped, arranged on the other element of cover and flange, in particular an end or an edge section of the indentation, in such a way that the cover is stopped during the rotation from the second rotational position into the first rotational position and/or beyond this, in particular into the first rotational position.

The dome cover assembly is advantageously designed in such a way that the reach-around element and/or in particular a projection of the reach-around element arranged thereon, which engages in the recess, which is in particular not extending up to the margin, in particular a head of the reach-around element, passes over at least one section and/or at least one section of the edge, in particular two sections and/or at least two sections of the edge, of the recess, which is in particular not extending up to the margin, in particular at least one edge section and/or section at the end and/or at least one section located toward the indentation and/or toward the opening of the indentation, of the recess, which is in particular not extending up to the margin, during the rotation from the first into the second rotational position. The passing over takes place in particular here in such a way that before the passing over, a greater distance is given between the side of the other element facing away from the first element and the projection than after, in particular measured in the direction of the longitudinal extension of the reach-around element, in particular its spacer section, in particular measured starting from the projection.

The dome cover assembly is advantageously designed in such a way that the reach-around element and/or in particular a projection of the reach-around element arranged thereon, which engages in the recess, which is in particular not extending up to the margin, in particular a head of the reach-around element, passes over at least one section and/or at least one section of the edge, in particular two sections and/or at least two sections of the edge, of the recess, which is in particular not extending up to the margin, in particular at least one edge section and/or section at the end and/or at least one section located toward the indentation and/or toward the opening of the indentation, of the recess, which is in particular not extending up to the margin, during the rotation from the second into the first rotational position. The passing over takes place in particular here in such a way that after the passing over, a greater distance is given between the side of the other element facing away from the first element and the projection than before, in particular measured in the direction of the longitudinal extension of the reach-around element, in particular its spacer section, in particular measured starting from the projection.

The at least one section, the sections together, and/or each of the sections advantageously has a length and/or circular arc section length of at least 1 cm, in particular at least 5 cm, and/or a circular arc section of at least 10°, in particular at least 20°, and/or at least 10%, in particular at least 20%, in particular at least 25%, of the width of the indentation and/or opening, wherein the width of the indentation is measured in particular in parallel to the width of the opening at a distance to the opening of less than 10% of the width of the opening and/or the width of the opening is the greatest opening width, in particular the longest extension of the opening in a plane parallel to one of the planes orthogonal to the axis. In particular, in the first, distant position of cover and flange, the section and/or the section of the edge of the recess, which is in particular not extending up to the margin, blocks the rotation from the first rotational position in the direction of the second rotational position by way of the reach-around element, in particular by way of a formfitting connection between reach-around element, in particular its head, and the section and/or section of the edge, whereby in particular a release of the through-opening is prevented. In particular, in the first rotational position in the second, closer position of cover and flange, the section and/or section of the edge of the recess, which is in particular not extending up to the margin, does not block the reach-around element during the rotation from the first into the second rotational position, rather the reach-around element passes over in particular the section and/or section of the edge, whereby the passage opening is released in particular by rotation from the first into the second rotational position of the cover.

The method is advantageously carried out by means of a dome cover assembly according to the invention and/or a tank and/or vessel and/or vehicle according to the invention. Advantageously, the dome cover assembly according to the invention and/or the tank and/or vessel and/or vehicle according to the invention are designed for carrying out the method.

Advantageous embodiments of the subjects according to the invention and the components thereof and of the method according to the invention and the means used for it are described hereinafter.

In general, multiple reach-around elements can be provided. One or several of them can be arranged on the cover and/or one or several can be arranged on the flange.

The reach-around element advantageously has a spacer section, which is oblong in particular, having a first section, in particular at the end, adjoining the spacer section, which first section forms the projection, wherein the first section extends at least partially transversely to the extension of the spacer section, wherein in particular the transverse extension of the first section engages in the recess. The projection is designed in particular, in particular circularly, at least in two opposite directions, in particular in all directions of a plane, in particular transversely to the longitudinal extension of the spacer section and/or in parallel to the plane in which the through-opening lies. The projection is designed in particular in at least two opposite directions which are transverse to the longitudinal extension of the spacer section and/or parallel to the plane in which the through-opening lies, and transverse to the direction of the rotation from the first into the second rotational position. Transverse is understood in this case in particular as an angle between 70 and 110 and/or −70 to −110° to the tangent on the rotation from the first into the second rotational position in the first position on the reach-around element.

The reach-around element advantageously has a spacer section, which is oblong in particular, wherein a projection, in particular a head, for at least partially enclosing the spit-shaped indentation and/or for engaging in the recess on the other element is arranged on a first section, which is in particular at the end, of the spacer section. The projection advantageously has a width, in particular a width perpendicular to the longitudinal extension of the spacer section and/or parallel to the plane in which the through-opening lies, and in particular also transversely to the direction of the rotation from the first into the second rotational position, which is wider than the width of the reach-around element over at least 20%, in particular at least 25%, in particular at least 50% of its longitudinal extension.

In particular, the shape of the at least one reach-around element has the shape of an anchor having the anchor tip as the first section. In particular, the reach-around element is a locking bolt and/or a clamp, wherein the head of the locking bolt and/or an end of the clamp engages in the recess.

The axis and at least one reach-around element are advantageously arranged in such a way that the reach-around element moves from the first into the second rotational position on a circular path in a first circular direction, which in particular opens the through-opening, and from the second into the first rotational position on one, in particular the circular path in a second circular direction, which in particular closes the through-opening and is oriented opposite to the first.

In particular, projection and recess are designed in such a way that the projection receives the recess and/or the recess surrounds the projection on at least three, in particular four, in particular five sides, in particular with a play of less than 5 mm in each case.

A recess not extending up to the margin is to be understood in particular as one which has a section not on the margin. A recess is to be understood in particular as a recess which has recessed flanks. A plurality of steps thus has step surfaces and recess flanks arranged between them from one step surface to the next. In the present case, the differentiation between surface and flank can be made in particular on the basis of the orientation in relation to the axis of the rotation between first and second rotational position and/or to the plane of the through-opening.

A section is not extending up to the margin in particular if and only if it is not on the margin of to the outer edge of the other element. The outer edge is to be understood in particular as the circumferential edge in a plane parallel to the plane of the through-opening and/or perpendicular to the axis of the rotation.

The other element of cover and flange particularly advantageously has an indentation, which is in particular spit-shaped, in particular for at least partially accommodating at least one reach-around element. The spit advantageously opens in one direction, wherein this direction is in a plane parallel to the plane in which the through-opening is arranged. Alternatively or additionally, in particular the opening of the spit is arranged in such a way that the reach-around element is moved through the opening into the indentation during the rotation of the cover in relation to the flange from the second into the first rotational position. Alternatively or additionally, in particular the opening of the spit is arranged in such a way that the reach-around element is moved through the opening out of the indentation during the rotation of the cover in relation to the flange from the first into the second rotational position. Alternatively or additionally, the opening of the spit has an opening angle of less than 180°.

In particular, the spit-shaped indentation has a stop surface for delimiting the rotation of the cover and/or for blocking the rotation of the cover upon reaching the first rotational position of the cover in relation to the flange.

In the first rotational position, in the first, distant position of cover and flange, a part of the reach-around element, in particular its head and/or projection, is advantageously engaged in a formfitting manner with the other element of flange and cover by way of the recess, which is not extending up to the margin, in particular in a plane parallel to the through-opening.

The reach-around element is, in particular all reach-around elements are, advantageously connected fixedly, in particular in a rotationally-fixed manner, and/or rigidly and/or fixedly to the first element of flange and cover. In particular, the alignment of the reach-around element is not pivotable in relation to the first element of flange and cover, rather in particular at least one reach-around element, in particular all of them, extends out from the first element of flange and cover, in particular perpendicularly thereto and/or to the plane in which the through-opening lies, in the direction of the other element of flange and cover.

The reach-around element is, in particular all reach-around elements are, advantageously connected fixedly, in particular in a rotationally-fixed manner, and/or rigidly and/or permanently, to the first element of flange and cover in a connection section of the first element. The reach-around element advantageously has the projection, in particular head, on an end of the reach-around element facing away from the connection section, wherein the projection is spaced apart from the connection section, in particular to form a spacer section of the reach-around element, in particular of the oblong section thereof. Advantageously, a sleeve, which surrounds the spacer section and spaces apart the connection section from the projection and/or is rotatable around its longitudinal extension, is arranged between connection section and projection for the in particular stable spacing and/or for securing the stop of the reach-around element in the indentation and/or for reducing the resistance during the entry of the reach-around element into the indentation.

The at least one reach-around element is advantageously designed and arranged in such a way that the distance, in particular the distance, in particular in the first rotational position and second rotational position, between an edge of the projection closest to the connection section and the connection section, and/or the length of the spacer section is constant and/or invariable, in particular in the length and/or the lengths and/or in the alignment and/or the alignments of the distance and/or the spacer section relative to the first element of cover and flange, in particular during the rotation, in particular during the rotation of the cover from the first into the second and/or from the second into the first rotational position and/or in the first and/or the second rotational position and/or in the open and closed state.

In particular, the at least one reach-around element is not changed in its alignment in relation to the first element of cover and flange to open, seal, and/or close the dome cover assembly and/or during the rotation from the first into the second rotational position and/or from the second into the first rotational position. In particular, the distance between an edge of the projection closest to the connection section and the connection section, and/or the length of the spacer section is not changed during the opening, sealing, and closing of the dome cover assembly.

If the cover is pressurized in the first rotational position, which exerts a force on the cover, which is oriented in the direction of the first, distant position of cover and flange, and the pressure in particular exceeds a predetermined limit and/or the pressure difference above the cover and/or between above and below the cover, in particular between tank and/or vessel interior and tank and/or vessel exterior, and/or the pressure difference between above and below the cover exceeds a predetermined limit, the reach-around element engages behind the recess. In particular a rotation of the cover is thus prevented and in particular opening is thus prevented. The dome cover assembly and/or cover and/or flange is/are designed in such a way that a seal is given between cover and flange even in the distant position. For this purpose, cover and/or flange can has/have one or more seal element(s), for example, one or more elastic seal element(s). In particular, at least one element of flange and cover has a hollow seal, which is circumferential and/or inflatable, in particular around this element, arranged toward the other element, wherein the hollow seal in particular has a cavity for the application of gas and/or fluid and the dome cover assembly in particular has means for introducing gas and/or fluid into the cavity, in particular a feedthrough through flange and/or cover. Thus, in the inflated or pressurized state, not only can a reliable seal also be achieved in the distant position, but also an additional force can be applied for pre-tensioning in the distant position. Additionally and/or alternatively, upon the discharge and/or suctioning out of the gas and/or fluid, a reduction of the friction and/or material protection can be achieved during the rotation out of the first rotational position, in particular into the second rotational position, in particular by reducing the size of the extension of the hollow seal between cover and flange.

The reaching behind particularly advantageously prevents the rotation around the axis from the first rotational position and/or into the second rotational position and/or reach-around element and/or recess are designed to prevent the rotation around the axis out of the first rotational position and/or into the second rotational position. The opening can thus be prevented in a simple manner.

In particular, in addition to the rotation, the rotatable mounting also enables the movement between first, distant and second, closer position and/or the movement between first, distant and second, closer position is a linear movement at least partially along the axis of rotation between first and second rotational position and/or the rotatable mounting is in particular a movement along the axis and a movement by tilting the cover or flange in relation to the axis. In particular, the reaching behind and/or the movement between first, remote and second, closer position is effectuated by a linear movement at least partially along the axis of rotation between first and second rotational position and/or the rotatable mounting is effectuated in particular by a linear movement along the axis and a tilt of the cover or flange in relation to the axis.

In particular, the distance between first, distant and second, closer position, in particular along the axis of rotation, and/or the length of the linear movement is between 700 mm and 800 mm.

In particular, the rotation between first and second rotational position is a rotation by 90° to 100°, in particular along the first, opening circular direction.

Advantageously, the distance in the first, distant position between flange and cover is between 5 mm and 15 mm and/or in the second, closer position the distance between flange and cover is between 5 mm and 7 mm and/or the recess has a height in the range of 1 mm to 3 mm and/or the reach-around element has a corresponding projection or recess, in particular in the range of 4 mm to 6 mm and/or the recess extends from flange and/or cover and/or the reach-around element in parallel to the rotational axis of the rotatable mounting and/or to the axis of rotation between first and second rotational position.

The through-opening advantageously has a size in the range of DN400 to DN800 and/or a diameter in the range of 380 mm to 780 mm.

Advantageously, a plurality of auxiliary clamps will be and/or is provided on at least one first element of cover and flange, which are each connected to the other element, in particular two to five are connected to the cover and/or two to five are connected to the flange, which are designed in the first rotational position to enclose at least partially the respective other element of cover and flange, on which this respective auxiliary clamp is not arranged, on the side facing away from the element of cover and flange on which this respective auxiliary clamp is arranged, and/or, in particular in the first rotational position, to prevent the movement from the second, closer position beyond the first, distant position, in particular together with the reach-around element, and/or are designed for this purpose.

In particular, flange and/or cover is/are/will be fixed having a radial play between 0.02 and 0.08 mm, in particular between 0.03 and 0.7 mm, and/or having a play in the longitudinal direction of the axis between 0.1 and 0.5 mm, in particular between 0.15 and 0.35 mm, on the axis, and/or axis, flange, and/or cover are designed in such a way that they enable a tilt of flange and/or cover in relation to the axis having a maximum tilt in the range of 0.5° to 1°. The rotation and/or tilt and/or movement between the positions may thus be enabled in a simple and reliable manner.

Advantageously, a hollow seal, which is in particular circumferential and/or inflatable, in particular around the first element, is advantageously arranged on a first element of flange and cover toward the other element, wherein the hollow seal in particular has a cavity for the application of gas and/or fluid and the dome cover assembly in particular has means for introducing gas and/or fluid into the cavity, in particular a feedthrough through flange and/or cover.

The flange is/will be particularly advantageously cast. This enables a simple, cost-effective, and pressure-resistant production and a long service life.

The dome cover assembly according to the present disclosure advantageously does not protrude into the tank or cover, the dome opening of which it closes, and/or it is correspondingly designed. This enables better loading, simpler cleaning and installation, and it enables a further opening and/or a feedthrough through the wall of the tank or vessel to be avoided.

The cover is particularly advantageously designed pressure-tight and/or pressure-resistant and/or it is designed so as not to impair unloading of a tank or vessel which encloses through another opening by means of pressurizing to the tank or vessel. Due to such an embodiment, the tank can be unloaded by pressurizing through a further opening, for example in a lower-lying region than the dome cover assembly. In particular, unloading through a further opening is effectuated by means of pressurizing the tank or vessel, in particular with closed dome cover assembly. The tank or vessel and/or the tank or vessel vehicle is advantageously designed for unloading by pressurizing the tank or vessel, in particular through a further opening of the tank or vessel and/or it contains a device for pressurizing the tank or vessel.

Tank, vessel, dome cover assembly, and/or tank or vessel vehicle advantageously has means for pressurizing the tank or vessel using gas and/or fluid and/or means for application of gas and/or fluid and/or venting, pressure relief, and/or pumping out of the cavity of the hollow seal.

The method advantageously includes pressurizing the cavity of the hollow seal using gas and/or fluid and/or venting, relieving pressure, and/or pumping out of the cavity of the hollow seal.

The axis of the rotation between first and second rotational position is advantageously arranged in parallel to the axis of symmetry, in particular the highest axis of symmetry, or normal of the through-opening and/or at a distance of 200 to 500 mm from the through-opening.

The clamps and/or auxiliary clamps are advantageously hold-downs.

The clamps and/or auxiliary clamps are advantageously designed U-shaped, T-shaped, or L-shaped, wherein the leg length is unequal in a U-shaped formation.

An embodiment is preferred in which in the first rotational position, the reach-around elements, in particular the clamps, and auxiliary clamps, which are connected to the cover, are in a first circular sector of a circle perpendicular to the axis of rotation between first and second rotational position and having center point in the center of the cover and/or the through-opening and/or the reach-around elements, in particular clamps, and auxiliary clamps, which are connected to the flange, or in a second circular sector of a circle perpendicular to the axis of rotation between first and second rotational position and having center point in the center of the cover and/or the through-opening, wherein the circular sectors in particular do not overlap and/or each enclose a circular arc angle of less than 180°, in particular less than 135°, and/or in that the axis of the rotation between first and second rotational position perpendicularly intersects the extension of a radius of the circle which is between the first and second circular sector and/or the two circles and/or their radii are identical and/or one of the two circles is identical to the outer circumference of the cover and/or one of the two circles is identical to the outer circumference of the flange.

An actuator, in particular pneumatic or electric, is advantageously provided, which is designed and arranged to effectuate the movement from the first into the second rotational position and from the second into the first rotational position.

Preferably, a first arm is arranged on the flange and a second arm is arranged on the cover and the axis of the rotation between first and second rotational position is fixed on the first and on the second arm and in particular a third arm is arranged on the flange or on the cover and an actuator is fixed on the first or second arm, in particular with a first end, and on the third arm, in particular with a second end opposite to the first end, wherein the actuator is fixed in such a way that it is fixed on one arm of the flange and on one arm of the cover.

The hollow seal is advantageously arranged between flange and cover and/or designed in such a way that it is arranged circumferentially around the through-opening in the closed state. The hollow seal is preferably an inflatable seal and/or a fabric-reinforced seal and/or a rubber seal. In particular in the pressurized state, in the cross section perpendicular to its longitudinal extension, which is arranged in particular in a circular shape, it has a round or oval section having a cavity therein and a web or bit arranged on this round or oval section outside the cavity and in particular designed as solid material and/or without a cavity, which is arranged in particular oriented toward a device for fixing the seal in relation to and/or toward the flange or cover. In particular, the seal has a material pretension in such a way that in the pressurized state or in the idle state, it lets the circular or oval section collapse, so that it reduces the height of the seal in cross section, in particular by one-third to two-thirds of the height of the round or oval section and/or between 10 and 20 mm. In particular the cavity has an area between 1 and 15 $cm^2$ in cross section. In the pressurized state, the cavity of the seal is pressurized, in particular at a pressure in the range of 3 bar to 5 bar. In particular, the hollow seal is arranged and designed in such a way that in the pressurized state, it is designed to exert a force pressing apart the flange and the cover between 1.8 kN and 3.7 kN and/or a pressure pressing apart the flange and the cover in the range of 2 bar to 4 bar.

Means are advantageously provided for pressurizing the hollow seal and for relieving pressure from the hollow seal and are fluidically connected to the cavity of the hollow seal, for example, a compressor, lines, and/or valves.

The cover and/or the flange are preferably held in a direction of the longitudinal extension of the axis of rotation between the first and second rotational position on this axis and/or a bolt used as the axis by a castle nut, which is secured in particular by a split pin, which is guided through the axis and the castle nut, in particular its grooves, against pivoting relative to the bolt and/or axis. In particular the castle nut has a groove at least every 80°, in particular every 60°.

In particular, the rotation of the castle nut on the axis around the groove corresponds to a displacement in the longitudinal direction of the axis of rotation between first and second rotational position between 0.1 and 0.5 mm.

The dome cover assembly and/or the axis of rotation between first and second rotational position advantageously does not extend into the tank or vessel and/or does not extend below the flange, if the flange is arranged in the horizontal and/or vertical with the axis and the cover above the flange. In particular, the dome cover assembly only contains one cover and/or only the flange and one cover is linked on the axis and/or at most one cover is linked on. In particular, the cover is located above the flange and/or outside the tank and/or vessel and/or the dome cover assembly is designed accordingly.

Advantageously, the extension of the dome cover assembly in one longitudinal direction of the axis of rotation between first and second rotational position is delimited by the flange and in particular in another longitudinal direction by the cover, possibly with the exception of the actuator and its fastening.

The cover is advantageously pivotable, in particular tiltable, in relation to the flange, in addition to the rotation around the axis, also around a pivot axis arranged transversely, in particular perpendicularly to the axis, in particular by more than 45°, in particular by at least 90°. In particular, the dome cover assembly has at least one hinge and/or at least one hinge is arranged between cover and flange, by means of which the pivot axis is implemented. In particular, the pivot axis extends in parallel to a plane in which the through-opening is arranged.

Cover and/or flange and in particular also the arms are particularly advantageously manufactured, in particular cast, from EN AW-5086, AW-5083, and/or AW-6082, in particular corrosion adapted and/or made of an alloy containing, in addition to aluminum or aluminum and others, the following Cr: 0.05-0.25 mass-percent,
Cu: maximum 0.15 mass-percent,
Fe: maximum 0.50 mass-percent, in particular 0.4-0.5 mass-percent,
Mg: 3.5-5 mass-percent,
Mn: 0.2-1 mass-percent,
Si: maximum 0.60 mass-percent,
Ti: maximum 0.2 mass-percent, and
Zn: maximum 0.3 mass-percent.

This enables a long-term pressure-resistant production in the casting method. In particular the dome cover assembly and/or flange and in particular also the arms are cast parts. In particular, the flange is cast in one piece, in particular together with at least one, in particular two arms. In particular, the cover is cast in one piece, in particular together with at least one arm.

The fitting or the fittings for pressurizing the hollow seal are particularly advantageously arranged in the slipstream, in particular with respect to the travel wind of the vehicle in the forward direction, of the flange and/or cover.

The dome cover assembly is or will be particularly advantageously designed, by interaction of the reach-around element, in particular the clamp, and the recess, to prevent opening of the cover and/or movement, in particular by the actuator, of the cover out of the first rotational position, as long as a force which exceeds a predetermined force is exerted on the cover, in particular by the hollow seal and/or the internal pressure in the tank or vessel.

The recess is advantageously designed in such a way that it is recessed in parallel and/or at an angle of +/−0 to 10° to the longitudinal extension of the axis of the rotation between first and second rotational position and/or has a recess depth, in particular due to a continuous recess flank and/or recess side, between 1 to 6 mm, in particular 2 to 4 mm. This recess side or recess flank then extends in particular perpendicularly and/or an angle of +/−90 to 80° to the plane in which the through-opening lies, and/or in parallel and/or at an angle of +/−0 to 10° to the longitudinal extension of the axis of rotation. In particular, the reach-around element is designed in such a way that in the first rotational position in the first, distant position of cover and flange, it presses against the recess flank and/or recess side, in particular with at least one surface section of the surface of the reach-around element parallel to the recess flank and/or recess side, in particular over 1 to 6 mm, in particular 2 to 4 mm, of the recess depth and/or over a width and/or a circumferential length between 60 and 120 mm.

The through-opening ridiculously advantageously has a through area between 0.1 and 0.5 $m^2$.

BRIEF DESCRIPTION OF THE SEVERAL VIEWS OF THE DRAWINGS

Further advantages and features of the invention result by way of example from the following description of an exemplary embodiment on the basis of the appended schematic figures. In the figures:

FIG. 1 shows a perspective view of a first exemplary embodiment of a dome cover assembly according to the invention, FIG. 2 shows a cross section through a clamp and a cover in the first, distant position of cover and flange from FIG. 1, FIG. 3*a* shows a longitudinal section of flange, cover, and auxiliary clamp in the second, closer position of cover and flange, FIG. 3*b* shows a longitudinal section of flange, cover, and auxiliary clamp in the first, distant position of cover and flange.

In the figures, identical elements are provided with identical reference signs.

DETAILED DESCRIPTION

Figure 4A:
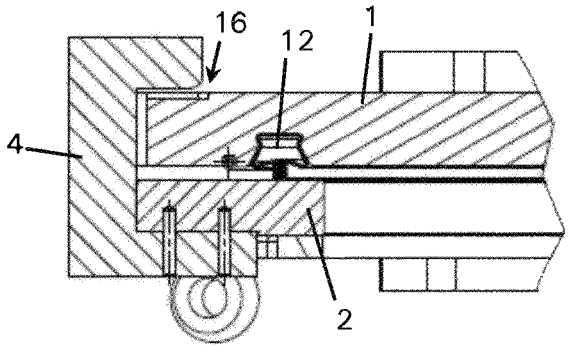
FIG. 4*a* shows a cross section through an auxiliary clamp, a flange, and a cover in the second, closer position of cover and flange.

FIG. 1 shows an advantageous first exemplary embodiment of a dome cover assembly according to the invention in a top view of the cover 1. The dome cover assembly is shown in the first rotational position. The flange 2 is shown below the cover 1. The flange 2 surrounds and encloses the dome opening (not shown) or the through-opening. Such a flange 2 is typically arranged on a tank or vessel (not shown). The cover 1 completely covers, in the first rotational position, the dome opening or the through-opening, whereby the dome opening or through-opening is closed, in particular in a fluid-tight manner or so it is impermeable to gas. The cover 1 is rotatable around the rotational axis 6 in relation to the flange 2 and the first arm 9 arranged on the flange, and thus in relation to the dome opening or through-opening. An actuator 15 can be used for this purpose. This is connected at its ends, a first end, to a second arm 10, which is arranged on the cover 1, and another end, a second end, which is opposite to the first end, to a third arm 11, which is arranged on the flange 2. The actuator comprises in particular a linear drive, which changes its longitudinal extension upon activation of the actuator, so that the second arm 10 is moved in relation to the third arm 11, whereby the cover 1 rotates around the rotational axis 6 in relation to the flange 2 and the through-opening or dome opening is opened or becomes free. The opening direction of the cover is as shown in FIG. 1 here.

A clamp 3, as an embodiment of the reach-around element according to the invention, and two auxiliary clamps 4 are arranged on the flange 2. Three auxiliary clamps 5 are arranged on the cover 1. The three auxiliary clamps 5 are arranged on a circular sector of the cover 1, which circular sector corresponds to the circular sector of the surface of the cover 1 which corresponds to half of the circle of the surface of the cover 1, which half is the half of the surface of the cover 1 which goes in the direction of the opening direction. It is ensured by this arrangement of the three auxiliary clamps 5 within this circular sector that the cover 1 may be moved into the second rotational position, since it also moves the auxiliary clamps 5. The clamps 3, and also the auxiliary clamps 4, are arranged in a circular sector which lies on the other half of the circle. This prevents the dome cover assembly from being able to be rotated/moved out of the second rotational position beyond the first rotational position.

A detail illustration of a clamp 3 according to the invention and a cover 1 is shown in FIG. 2 by means of a cross section through a part of the clamp 3 and the cover 1 along the section line A-B from FIG. 1. The clamp 3 is arranged on the flange 2 (not shown) and is connected thereto, for example, by means of screws (not shown). The clamp 3 engages with a projection located at its end behind a part of the cover, in that the clamp 3 engages with this end in a recess 7, which is not extending up to the margin, of the cover 1. It is ensured by the recess 7, which is not extending up to the margin, that the clamp 3 cannot slide off of the cover 1 in the direction of the margin of the cover. The cover 1 is thus fixed by means of the clamp 3 in such a way that it is restricted in its rotational movement around the flange 2 or the bolt, or this movement is prevented. However, it is also possible in principle that the clamp 3 would be arranged on the cover 1 and thus the clamp 3 engages in a recess 7, which is not extending up to the margin, of the flange 2. Such a clamp is to be arranged in the other half of the circle than that shown in FIG. 1, however, so that the dome cover assembly is prevented from being able to be rotated/moved from the second rotational position beyond the first rotational position, and so that the dome cover assembly can be moved from the first rotational position into the second rotational position.

In FIG. 2, the arrangement in the distant position is shown. By lowering the cover 1 into the closer position, the engagement of the clamp behind the recess of the cover 1 can be canceled.

The cover 1 first tapers starting from the thickness or height shown on the left in FIG. 2 to the right and thus forms a recess. It is not necessary for it to be embodied in one piece. The region of greater thickness or height could also be implemented, for example, by screwing on a bar or bracket, for example. In FIG. 2, the cover thickens again in the further course to the right. However, this is not necessarily required.

FIGS. 3*a* and 3*b* each show a section through the cover and the flange in a top view of an auxiliary clamp 4, arranged on the flange 2. The cover 1 and the flange 2 are in the first rotational position, thus in the position in which the cover 1 covers the dome opening or through-opening. The seal arranged between cover and flange is not shown.

In the exemplary embodiment, the cover has a recess at the end, in which the auxiliary clamp 4 can engage and thus receives a lateral guide in the figure and thus further stabilizes the assembly.

In FIG. 3*a*, the state during the second, closer position between cover 1 and flange 2 is shown. In FIG. 3*b*, the state during the first, distant position between cover 1 and flange 2 is shown.

Figure 4B:
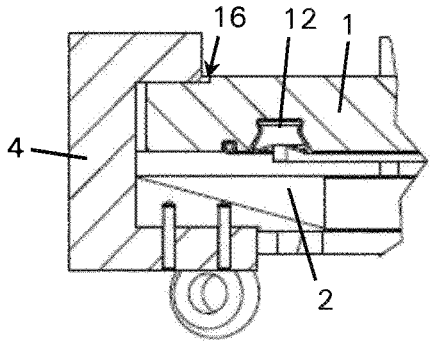
FIG. 4*b* shows a cross section through an auxiliary clamp, a flange, and a cover in the first, distant position of cover and flange.

The auxiliary clamps from FIGS. 3*a* and 3*b* are again shown in FIGS. 4*a* and 4*b*. These auxiliary clamps 4 differ from the auxiliary clamps 5 in that the auxiliary clamp 4 is fastened on the flange 2, whereas auxiliary clamps 5 are fastened on the cover, see also FIG. 1 in this regard. In FIG. 4*a*, the state of the second, closer position of cover and flange is shown, in FIG. 4*b*, the state of the first, distant position of cover and flange is shown, both in the first rotational position in each case.

The auxiliary clamp 4, arranged on the flange 2, partially encloses and surrounds the side of the cover 1 facing away from the flange 2. The cover has the optional recess at the end here, in which the auxiliary clamp 4 engages in FIG. 4*b*. Due to the second, closer position of cover 1 and flange 2 in FIG. 4*a*, however, the cover is not restricted or limited by the auxiliary clamp 4 and the auxiliary clamp does not engage in the recess at the end, arranged on the cover 1.

The cover 1 and the flange 2 can be moved from the second, closer position of cover 1 and flange 2 due to an overpressure in a container below the cover 1, whereby a through-opening thereof is surrounded by the flange 2, in the first, distant position of cover 1 and flange 2.

In an overlapping region of the cover 1 and flange 2 located in the first rotational position, a hollow seal 12 is arranged on the cover 1, which extends in the direction of flange 2 and which is arranged on the side of the cover 1 facing toward the flange 2. A line, for example a gas line (not shown), is guided to this hollow seal 12. The hollow seal 12 is designed having a cavity 17, which can be filled with a fluid, for example air, by means of the line or emptied, in particular deaerated. It is designed together with the cover 1 and the flange 2 to completely close the dome opening or the through-opening, for example, of a container, a tank, vessel, or a tank or vessel vehicle, in the first rotational position, at least in the second, closer position but in particular also in the first, distant position of cover 1 and flange 2. For this purpose, the hollow seal is arranged completely enclosing the through-opening or dome opening or along the entire circumference of the flange 2, but not necessarily in the region of the largest circumference. It is also possible that due to pressurizing, thus filling of the cavity 17 of the hollow seal 12, the hollow seal alone assists or effectuates the movement of the cover 1 from the second, closer position of covered 1 and flange 2 into the first, remote position of cover 1 and flange 2. In FIG. 4*b*, the first, remote position of cover 1 and flange 2 is shown, wherein no pressurizing of the hollow seal 12 is present or the cavity 17 of the hollow seal 12 was emptied or the fluid located therein, for example air, was discharged and/or suctioned off, so that the hollow seal 12 does not extend up to the side of the flange 2 facing toward the cover 1.

Figure 5:
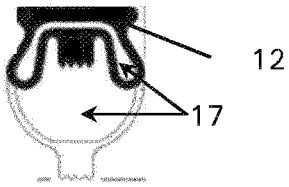
FIG. 5 shows a cross section through a hollow seal.

The hollow seal 12 from FIGS. 4*a* and 4*b* is shown in a detail view in FIG. 5. A line (not shown) on the hollow seal 12 enables emptying or filling with fluid, for example air, of the cavity 17, so that the lower part of the hollow seal 12 moves relative to the upper part of the hollow seal 12, which is arranged fixed in the cover 1, as shown in FIGS. 4*a* and 4*b*.

Figure 6:
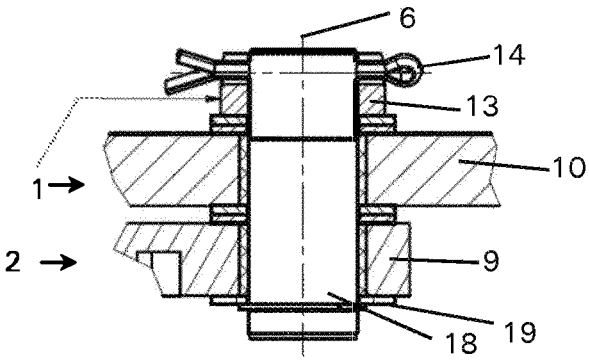
FIG. 6 shows a cross section through the rotational axis.

A detailed illustration of the parts located on the axis of rotation between first and second rotational position, thus the rotational axis 6, is shown in FIG. 6 by means of a cross sectional illustration through the rotational axis 6. A bolt 18 acting as an axis is arranged in the rotational axis 6, which is guided through both a round opening of the first arm 9, arranged on the flange 2, and also through a round opening of the second arm 10, arranged on the cover 1. A castle nut 13 holding the bolt 18 is arranged on a part of the bolt 18 protruding beyond the second arm 10, through which in turn a split pin 14 is guided for fixing the castle nut 13 with the bolt 18 and preventing the rotation of the castle nut 13 in relation to the bolt 18. The guiding of the split pin 14 through the castle nut 13 takes place through one of multiple grooves arranged in the castle nut 13 and a drilled hole through the bolt. At the other end of the bolt, it is secured using a lock ring 19.

By rotating the castle nut before securing it using the split pin 14 and subsequently securing it using the split pin, a desired play can be set, whereby the maximum distance between cover 1 and flange 2 at the bolt along the rotational axis 6 may be set in the first, distant position of cover 1 and flange 2. Washers are arranged between the flange and cover on the bolt to set the distance between the flange and cover. By selecting the openings in cover and flange in relation to the diameter of the bolt and selecting the thickness of the washers and the maximum distance, the maximum tilt of cover and flange in relation to one another and the linear movement along the rotational axis may be set and thus the maximum movement between first, distant and second, closer position may be fixed.

Figure 7:
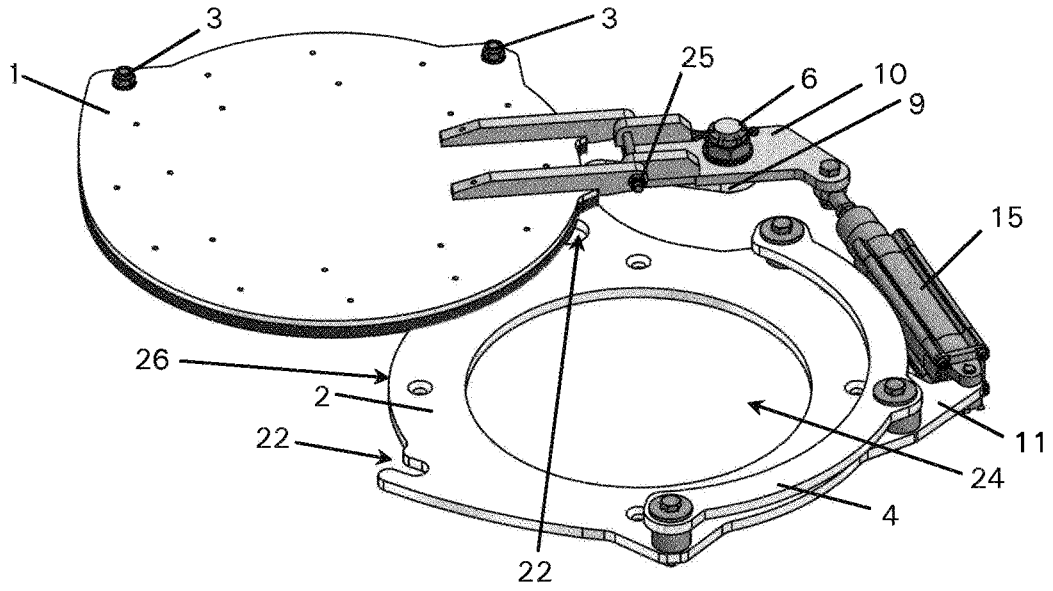
FIG. 7 shows a perspective top view of a second exemplary embodiment of a dome cover assembly according to the invention.

FIG. 7 shows a second exemplary embodiment of a dome cover assembly according to the invention, in which, inter alia, instead of a typical clamp as the reach-around element 3, a rotationally-symmetrical clamp 3 or an anchor 3 or a locking bolt 3 is used. This locking bolt 3 is arranged on the cover in this embodiment. The dome cover assembly is shown in the second rotational position of the cover, in which the through-opening 24 is released, so that the access to a tank is enabled, for example. During the rotation of the cover 1 from the second into the first rotational position of the cover, the reach-around element 3 is moved into a receptacle, a spit-shaped indentation 22 here. Furthermore, this exemplary embodiment has a pivot axis, using which the cover can also be pivoted in relation to the flange around the pivot axis 25, in addition to the rotation around the axis 6, and thus, for example, can be folded open and closed. A simple access to the cover lower side is enabled in this way.

In the embodiment shown in FIG. 7, two spit-shaped indentations 22 are arranged on the flange 2, wherein the openings of the spit, in particular the opening width, the opening angle, and/or the opening direction, is and/or are each designed and arranged in such a way that during a rotation of the cover 1 from the second into the first rotational position, one reach-around element 3 is moved in each case through the opening of the respective spit into the spit-shaped indentation 22. For this purpose, the spit-shaped indentations 22 are arranged adjoining an outer edge of the flange and each have an opening toward the margin of the flange. Furthermore, an auxiliary clamp 4 is arranged on the flange 2, which is designed bar-shaped. In this way, the first rotational position is delimited in at least one direction. The auxiliary clamp 4 is furthermore designed in such a way that the translational movement along the axis 6 away from the closer position is restricted and/or prevented thereby in the first rotational position in the distant position. This increases the stability and the possible pressure load of the dome cover assembly. This is advantageous in particular if a pivot axis 25 is provided, but also in general to save material on the axis 6 and the pivot arm.

Figure 8A:
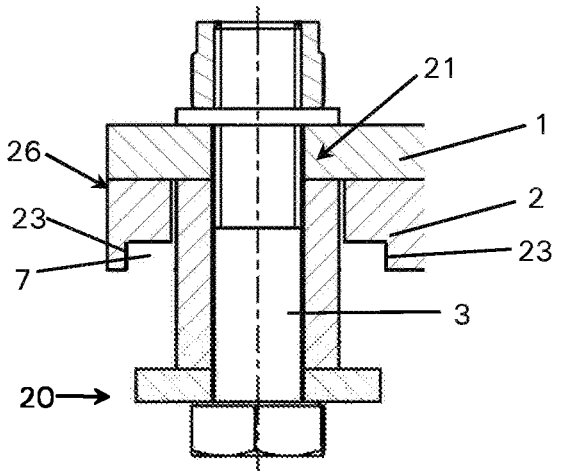
FIG. 8*a* shows a cross section through parts of a cover and a reach-around element of the second exemplary embodiment of FIG. 7.

FIG. 8*a* shows, not to scale, a cross section of a detail illustration of the reach-around element 3 of FIG. 7 arranged on the cover 1. Details are also shown of the cover 1 and the flange 2 in the closer position in the first rotational position. The reach-around element 3 is, for example, a bolt 3, which is connected and fastened to the cover in a connection section 22 of the cover 1 in a rotationally-fixed and rigid manner, for example, by means of a thread and a nut at one end of the bolt 3. In the exemplary embodiment, the longitudinal direction of this reach-around element 3, the bolt 3, extends with its spacing section and its spacing section arranged between connection section and projection orthogonally to the surface extension of the cover 1. At the other end, the end opposite to the nut, of the bolt 3, it has a projection, for example in the form of a head and a washer. This projection is spaced apart from the connection section to form a spacer section, wherein the distance between projection and connection section during the rotation and upon opening, sealing, and closing remains unchanged and/or is unchangeable. In the arrangement shown, the spacer section of the bolt 3 surrounded by the sleeve has been moved through the opening of the spit-shaped indentation 22 by rotation from the second into the first rotational position.

During the movement from the closer position shown into the distant position, by moving the cover 1 upward in the drawing, the projection 20 of the bolt enters the recess, which does not extend up to the margin, on the flange. The projection of the bolt 3 thus engages in the recess 7, which does not extend up to the margin. In this way, a formfitting connection takes place between projection and recess, which does not extend up to the margin, for example, in that the outline of the projection terminates flush with the delimitation, the edge 23, of the recess, which does not extend up to the margin.

Figure 8B:
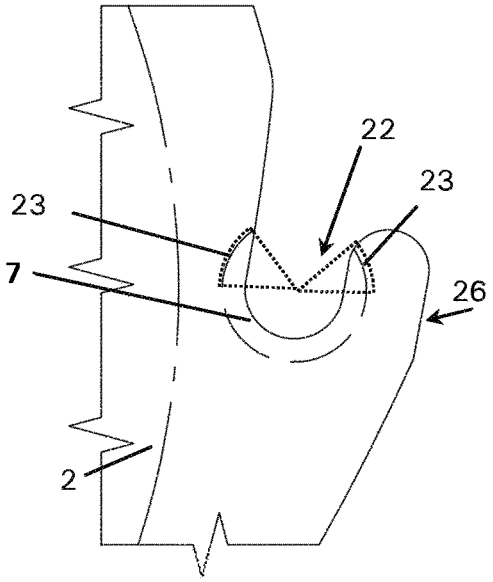
FIG. 8*b* shows a top view of a section of the lower side of the flange from the second exemplary embodiment of FIG. 7, showing the recess which does not extend up to the margin.

FIG. 8*b* shows a top view of the recess, which does not extend up to the margin, of the dome cover assembly according to the exemplary embodiment from FIG. 7. The lower side is shown, thus the side of the flange facing away from the cover, which has the recess, which does not extend up to the margin. The recess, which does not extend up to the margin, is designed here in such a way that its contour and/or outline and/or edges 23 at least partially enclose, namely by greater than 180° or approximately 250°, the opening of an indentation 22, the spit-shaped indentation 22 here. In relation to the opening, a part of the recess is possibly at the margin, but not in relation to the flange, which is important here. The recess is spaced apart in all directions from the outer edge or the margin of the flange, and thus does not extend up to the margin. Therefore, no recess is arranged at the outermost margin edges of the flange. The recess, which thus does not extend up to the margin, has an edge or a section of the edge of the recess, which does not extend up to the margin, which is oriented in the direction of the opening and/or is located toward the indentation and/or toward the opening of the indentation. During a rotation of the cover from the first rotational position in the direction of the second rotational position, the reach-around element, in particular its projection, has to pass over this edge or this section. The passed-over circular arc section of the edge is identified by pie-shaped dashed circular segments. However, passing over is only possible in the second, closer position of the cover since in the first, distant position of the cover, the reach-around element, in particular the projection, is blocked in its rotational direction by the edge and/or the section, in particular due to a formfitting connection between projection and edge and/or a section of the edge of the recess, which does not extend up to the margin.

LIST OF REFERENCE NUMERALS

1 cover
2 flange
3 reach-around element
4 auxiliary clamp
5 auxiliary clamp
6 rotational axis
7 recess, not at the margin
8 gas introduction means
9 first arm
10 second arm
11 third arm
12 hollow seal
13 castle nut
14 split pin
15 actuator
16 recess
17 cavity
18 bolt
19 lock ring
20 head of the reach-around element
21 connection section
22 spit-shaped indentation
23 edge of the recess, which does not extend up to the margin
24 through-opening
25 pivot axis
26 outer edge

The invention claimed is:

1. A dome cover assembly comprising:

a flange having a through-opening; and a cover for closing the through-opening;

wherein the cover is rotatably mounted around an axis in relation to the flange, so that in a first rotational position, the cover is positioned above the through-opening and in a second rotational position, the cover is positioned so that the through-opening is free;

wherein one of the cover and flange has a reach-around element which, in a first rotational position at least partially encloses the other of the cover and flange on a side facing away from the one of the cover and flange, and the other of the cover and flange has a recess on the side facing away from the one of the cover and flange in a direction of the one of the cover and flange;

wherein the reach-around element and the recess are arranged such that, in the first rotational position, in a first distant position of the cover and flange, the reach-around element engages behind the recess or into the recess, and in the first rotational position, in a second closer position of the cover and flange, the reach-around element does not engage behind the recess;

wherein the recess at least partially does not extend up to a margin of the other of the cover and flange or the axis;

wherein the other of the cover and flange and the reach-around element are arranged such that the reach-around element passes over at least a section of the recess during a rotation from the first rotational position into the second rotational position;

wherein before the passing over, there is a greater distance between the side of the other of the cover and flange facing away from the one of the cover and flange than after the passing over; and wherein the other of the cover and flange has an indentation which is spit-shaped, wherein the spit opens in one direction that is in a plane parallel to a plane in which the through-opening is arranged, or the opening is arranged such that the reach-around element is moved through the through-opening into the indentation during the rotation of the cover in relation to the flange from the second rotational position and into the first rotational position, or the opening has an opening angle of less than 180°.

2. The dome cover assembly as claimed in claim 1, wherein the engaging of the reach-around element behind the recess prevents the rotation of the cover around the axis out of the first rotational position and into the second rotational position.

3. The dome cover assembly as claimed in claim 1, wherein the reach-around element has a longitudinal extension or a longitudinal section, wherein a projection for at least partially reaching around the spit-shaped indentation or for engaging in the recess on the other of the cover and flange, is arranged on a section of the longitudinal extension or the longitudinal section, wherein the projection has a width, measured perpendicularly to the longitudinal extension or to the longitudinal section of the reach-around element which is wider than a width of the reach-around element over 25% of the longitudinal extension or longitudinal section.

4. The dome cover assembly as claimed in claim 3, wherein at least one section or at least one section of an edge or at least one section located toward the indentation or the opening of the indentation, of the recess not extending up to the margin is passed over by the reach-around element, during the rotation from the first rotational position of the cover into the second rotational position of the cover in relation to the flange, wherein the at least one section has a length or a circular arc section length of at least 1 cm or at least 10% of the width or the circular arc section of at least 10°.

5. The dome cover assembly as claimed in claim 1, wherein the rotatable mounting, in addition to the rotation, also enables movement between the first distant position and the second closer position and the movement between the first distant position and the second closer position is a movement at least partially along the axis of the rotation between the first rotational position and the second rotational position or the rotatable mounting.

6. The dome cover assembly as claimed in claim 1, wherein the distance between the first distant position and the second closer position is from 700 mm up to 800 mm or the rotation between the first distant position and the second closer position is a rotation by from 90° up to 100° or, in the first distant position, there is a distance of from 5 mm up to 15 mm between the flange and the cover or in the second closer position, the distance between the flange and the cover is from 5 mm up to 7 mm, or the recess has a height in the range of from 1 mm up to 3 mm or wherein the reach-around element has a corresponding recess or projection in the range of from 4 mm up to 6 mm, or the recess extends from the flange or the cover or the reach-around element extends in parallel to the rotational axis of the rotatable mounting or to the axis of the rotation between the first rotational position and the second rotational position or wherein the through-opening has a size of from DN400 up to DN800 or a diameter of 380 mm up to 780 mm.

7. The dome cover assembly as claimed in claim 1, wherein a plurality of auxiliary clamps is provided, which are each connected to the one of the cover and flange or extend around at least 30% of an external circumference of the one of the cover and flange, wherein the plurality of auxiliary clamps is arranged, in the first rotational position, to at least partially enclose the other of the cover and flange, on which the plurality of auxiliary clamps is not arranged, on the side facing away from the one of the cover and flange on which the respective auxiliary clamp is arranged.

8. The dome cover assembly as claimed in claim 1, wherein the flange or cover is fixed having a radial play between 0.02 and 0.08 mm, or having a play in the longitudinal direction of the axis between 0.1 and 0.5 mm on the axis, or the axis, the flange, or the cover is arranged such that they enable a tilt of the flange or the cover in relation to the axis having a value in the range of 0.5° to 1°.

9. The dome cover assembly as claimed in claim 1, wherein the one of the flange and cover has a hollow seal arranged toward the other of the flange and cover, wherein the hollow seal has a cavity for application of gas or fluid, and the dome cover assembly includes a means for introducing the gas or the fluid into the cavity via a feedthrough through the one of the flange and cover.

10. The dome cover assembly as claimed in claim 1, wherein the flange or cover is formed from EN AW-5086, AW-5083, and/or AW-6082, is corrosion adapted or made of an alloy containing, in addition to aluminum, Cr: 0.05-0.25 mass-percent,
Cu: maximum 0.15 mass-percent,
Fe: maximum 0.4-0.5 mass-percent,
Mg: 3.5-5 mass-percent,
Mn: 0.2-1 mass-percent,
Si: maximum 0.60 mass-percent,
Ti: maximum 0.2 mass-percent, and
Zn: maximum 0.3 mass-percent
or the flange or cover is cast.

11. The dome cover assembly as claimed in claim 1, wherein the dome cover assembly is arranged so as to not extend into a dome opening of a tank or vessel, which the dome cover assembly closes, or the dome cover assembly is configured to be pressure-tight or pressure-resistant, so as not to impair unloading of the tank or vessel through another opening by means of pressurizing the tank or vessel.

12. A tank or vessel having a dome opening and the dome cover assembly of claim 1 arranged on the dome opening, wherein the dome opening and the through-opening at least partially align or form a joint continuous opening, and wherein the dome cover assembly is arranged to completely close the dome opening in the first rotational position.

13. The tank or vessel as claimed in claim 12, wherein the dome cover assembly does not extend into the tank or vessel or wherein the tank or vessel has a means for pressurizing the tank or vessel or for applying and venting gas fluid to or from a cavity of a hollow seal of one of the flange or cover of the dome cover assembly.

14. The tank or vessel as claimed in claim 12, designed for unloading by pressurizing the tank or vessel.

15. A tank or vessel having the tank or vessel as claimed in claim 12.

16. The tank or vessel as claimed in claim 15, having a device for pressurizing the tank or vessel or a device for applying and venting gas or fluid to or from a cavity of a hollow seal of one of the flange or cover of the dome cover assembly.

17. A method for preventing opening of a dome cover of a tank or vessel, wherein by means of at least one reach-around element arranged on one of the dome cover and a flange of the tank or vessel and a recess arranged on the other of the dome cover and the flange of the tank or vessel, the opening or a rotation for opening is prevented by the at least one reach-around element engaging behind the recess in a first distant position of the dome cover and the tank or vessel, wherein the recess at least partially does not extend up to a margin of the other of the dome cover and the flange of the tank or vessel or the at least one reach-around element passes over at least a section of the recess during the rotation for opening or during opening, wherein before the passing over, a greater distance is measured between a side of the other of the dome cover and the flange of the tank or vessel facing away from the one of the dome cover and the flange of the tank or vessel and a projection or the reach-around element than after the passing over, wherein in a second closer position of the dome cover and the tank or vessel, the at least one reach-around element does not engage behind the recess; and wherein the other of the dome cover and flange has an indentation which is spit-shaped, wherein the spit opens in one direction that is in a plane parallel to a plane in which a through-opening is arranged.

18. The dome cover assembly of claim 1, wherein the reach-around element is an anchor or a clamp.

19. The dome cover assembly as claimed in claim 5, wherein the movement between the first distant position and the second closer position further comprises tilting the cover or flange in relation to the axis.

* * * * *